US005817399A

United States Patent [19]

Kalman

[11] Patent Number: 5,817,399

[45] Date of Patent: Oct. 6, 1998

[54] ARTICLE AND METHOD OF MANUFACTURE OF TWO-COLOR NON-SLIP TREAD OR FLOORING PLATE

[76] Inventor: James H. Kalman, 1153 3000 Valley Force Cir., King of Prussia, Pa. 19406

[21] Appl. No.: 755,427

[22] Filed: Nov. 22, 1996

[51] Int. Cl.[6] ..... E04F 11/104; B61D 23/00

[52] U.S. Cl. ..... 428/143; 428/148; 428/195; 428/192; 428/206; 428/207; 428/908.8; 52/177; 52/179; 427/301; 427/180; 427/190; 427/299; 427/282; 427/258; 427/261; 427/272; 427/264; 427/270; 427/284; 427/372.2; 427/388.1

[58] Field of Search ..... 428/143, 148, 428/195, 192, 206, 207, 908.8; 52/177, 179; 427/301, 180, 190, 299, 282, 258, 261, 272, 264, 270, 284, 372.2, 388.1

[56] References Cited

U.S. PATENT DOCUMENTS

| | | | |
|---|---|---|---|
| 2,106,399 | 1/1938 | Beaumont et al. | 20/79 |
| 2,246,898 | 6/1941 | Sayre | 94/5 |
| 3,675,385 | 7/1972 | Chan | 52/741 |
| 3,861,955 | 1/1975 | Lemelson | 117/235 |
| 3,924,023 | 12/1975 | Boranian et al. | 427/54 |
| 4,018,944 | 4/1977 | Hallstrom et al. | 427/140 |
| 4,272,211 | 6/1981 | Sabel | 404/21 |
| 4,278,483 | 7/1981 | Mansolillo | 156/79 |
| 4,289,819 | 9/1981 | Kalman | 428/57 |
| 4,496,414 | 1/1985 | Smith et al. | 156/246 |
| 4,528,231 | 7/1985 | Lund | 428/148 |
| 4,555,292 | 11/1985 | Thompson | 156/279 |
| 4,662,972 | 5/1987 | Thompson | 156/279 |
| 4,797,314 | 1/1989 | Davey et al. | 428/167 |
| 5,447,387 | 9/1995 | Fagan | 404/20 |
| 5,475,951 | 12/1995 | Litzow | 52/177 |

*Primary Examiner*—William P. Watkins, III
*Attorney, Agent, or Firm*—Michael F. Petock, Esq.

[57] ABSTRACT

A method of manufacturing a two-color non-slip tread or flooring plate includes the steps of dimensioning the plate, cleaning the plate and applying a bonding agent to the plate. A uniform layer of plastisol of a light color, containing gritty particles such as aluminum oxide, is sprayed on one of the surfaces of the plate or tread. After partial curing by baking, a masking material is applied along one of the edges. This edge is selected to be the edge which would abut a discontinuity in the floor such as the edge of a step or a flooring area which is raised. A second layer of plastisol containing gritty particles with a darker pigment is then sprayed on to the first layer of plastisol. The plastisol layers are then cured by baking and the masking material is removed. The invention includes tread plates and flooring plates made in accordance with the method of the present invention.

13 Claims, 1 Drawing Sheet

ARTICLE AND METHOD OF MANUFACTURE OF TWO-COLOR NON-SLIP TREAD OR FLOORING PLATE

CROSS REFERENCE TO RELATED PATENT

The inventor references his prior patent, namely U.S. Pat. No. 4,289,819 issued on Sep. 15, 1981, and incorporates by reference the teachings of his prior patent the same as if set forth at length.

FIELD OF THE INVENTION

The present invention relates to a method of manufacturing a two-color non-slip tread or flooring plate and such treads or flooring plates made by the method. More particularly, the present invention relates to a method of manufacturing such two-color non-slip tread or flooring plates having a continuous or unitary coating of non-slip material thereon. The step treads or flooring plates may be utilized in any application where a non-slip surface is desirable for standing or stepping onto, and particularly in applications where there is an edge or step on to the surface so that a person stepping on to the surface is alerted to the discontinuity, such as railway passenger car steps with formed front lips, pads for use as locomotive walkways, pads used on locomotive inside decks, caboose floors, dining area car floors, vestibule areas, for standing pads beneath machinery in shops and the like.

BACKGROUND OF THE INVENTION

There has been a need for satisfactory slip-resistant surfaces, particularly in locations such as steps utilized on public transportation vehicles such as railway cars, buses and the like. Further, there has been a need for providing a warning to passengers utilizing such steps or treads of the vehicles of the different step heights by a strip along the step edge of a different color. Applicant herein has provided in the past a suitable step tread plate as shown and described in his prior U.S. Pat. No. 4,289,819. However, the invention covered by his previous patent required the construction of two separate components which were then interleaved and bonded to the step typically by mounting screws fastening the two separate components to the step. The present invention provides an improved unitary two-color structure and a method of manufacturing such tread plate or flooring plate as a unitary structure.

A number of others in the past have done work in the area of providing treads for steps and other non-slip surfaces, and such work is an indication of the amount of effort that has gone into development in this area. These include U.S. Pat. No. 2,106,399—Beaumont, et al; U.S. Pat. No. 2,246,898—Sayer; U.S. Pat. No. 5,475,951—Litzow; U.S. Pat. No. 5,447,387—Reagan; U.S. Pat. No. 4,555,292—Thompson and U.S. Pat. No. 4,662,972—Thompson.

None of the disclosures by these workers teaches or suggests the method of manufacture and resulting product produced by the inventor herein.

SUMMARY OF THE INVENTION

One of the advantages of the present invention is that it provides a non-slip tread or flooring plate of unitary construction which provides contrasting colors, particularly along one of the edges.

Another advantage of the present invention is that it provides a method of producing a two-color non-slip tread or floor plate wherein the non-slip coating is of unitary construction.

In accordance with the present invention, a method of manufacturing a two-color non-slip tread or flooring plate includes the step of obtaining a metallic plate of a predetermined dimension, cleaning the metallic plate and applying a bonding agent to the metallic plate. The method further includes the step of spraying a plastisol of a first selected color on to the metallic plate with the bonding agent applied thereto, the plastisol, including gritty particles, is applied to the metallic plate in a predetermined thickness. After partially drying or curing the plastisol, at least one edge of the plate is then masked. The next step is the spraying of a plastisol of a second color to the plastisol of the first selected color. The second selected color is darker than the first selected color. The plastisol of the second selected color includes gritty particles and is applied in a thickness approximately one half of the first plastisol layer of the lighter color. The masking is then removed from the plate and the plastisol is cured by baking.

In a presently preferred embodiment, the plastisol of the first selected color is yellow or orange and the second color is black.

The invention further includes products made in accordance with the method of the present invention.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
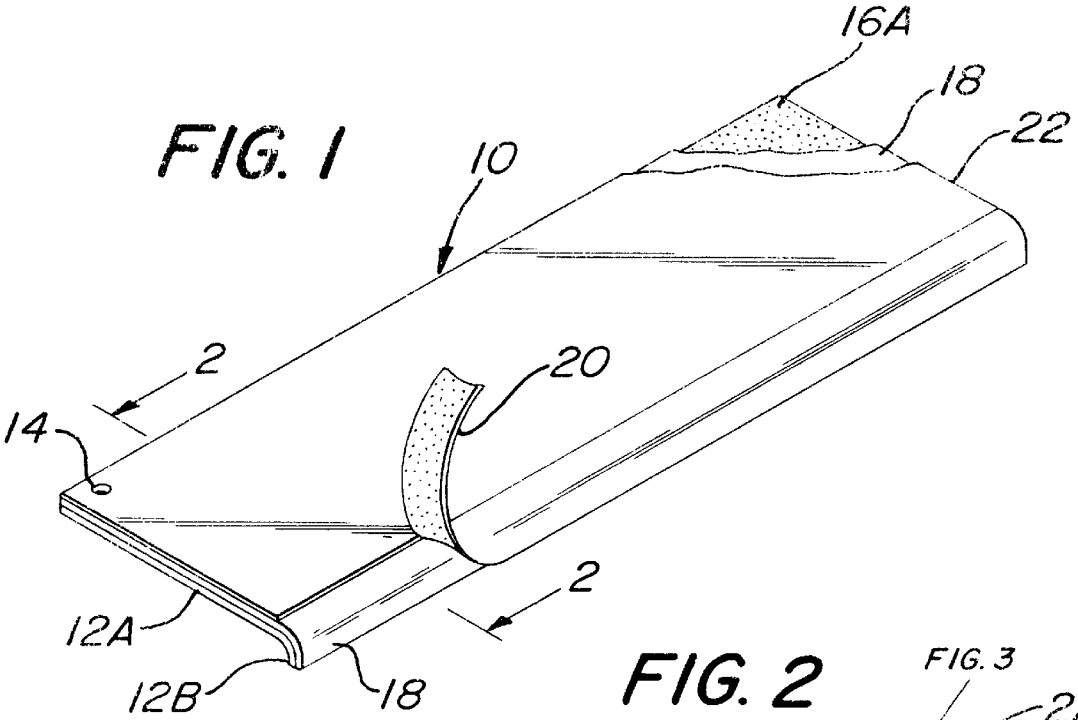
FIG. 1 is a partially broken away view in perspective of a tread plate made in accordance with the present invention illustrating masking material being removed.

Referring now to the drawings where like numerals indicate like elements, there is shown in FIG. 1 a tread plate 10 made by the method of the present invention. Tread plate ten is comprised of a metallic plate which may preferably be comprised of stainless steel 304-2B.

Figure 2:
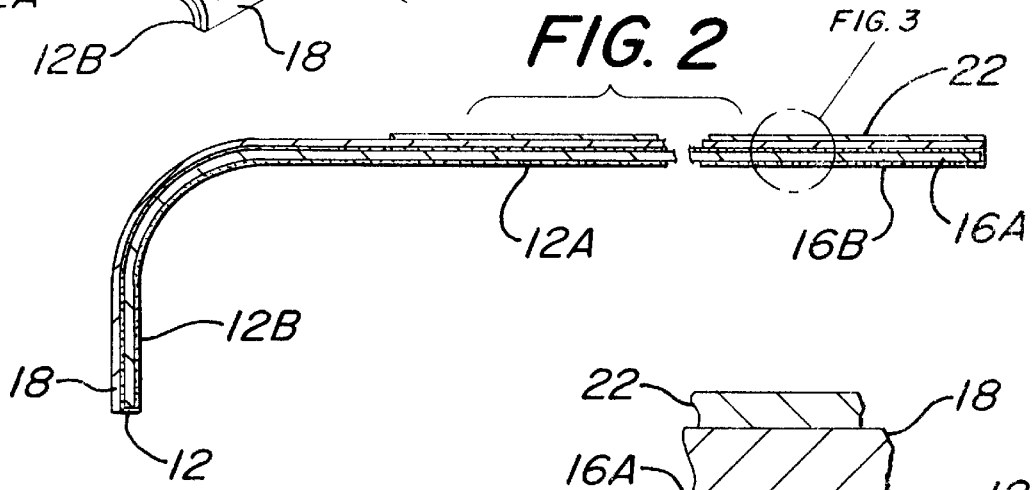
FIG. 2 is a cross-sectional view taken along Line 2—2 of FIG. 1.
Figure 3:
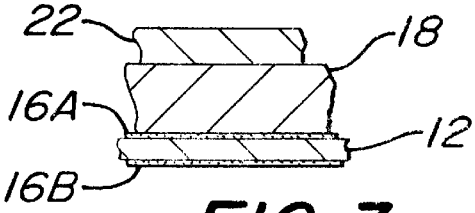
FIG. 3 is an exploded cross-sectional view of the encircled area of FIG. 2.

Referring to particularly FIGS. 1, 2 and 3, in particular, metallic plate 12 is cleaned by procedures well known to those skilled in the art to assure adequate bonding to the metallic plate. Metallic plate 12 may be formed generally in the shape of an "L" having a flat portion 12A and a lip portion 12B. Metallic plate 12 is cut to the proper dimensions to insure a proper fit for the tread plate 10 on a step to which it is to be applied, such as a railway car step. Typically, an overall width dimension might be on the order of 9.5 inches with a typical lip vertically depending length of about 0.75 inch. If the plate is to be applied by screws or rivets, as is common, the metallic plate 12 may be drilled to form holes 14 as shown in FIG. 1.

After cleaning of metallic plate 12, a bonding agent is applied to metallic plate 12, and preferably to the entire surface of metallic plate 12 including both the upper and lower edges as shown at 16A & 16B in FIGS. 2 and 3.

After application of the bonding agent, the upper surface of metallic plate 12, with the bonding agent 16A thereon, is sprayed with a plastisol containing gritty particles, such as aluminum oxide. This plastisol layer with the gritty particles is shown at 18 in FIGS. 1 through 3. This plastisol, with gritty particles, which forms layer 18 preferably contains pigments of lighter colors such as yellow or orange. Layer 18 may be of any suitable thickness, but preferably the thickness of layer 18 is approximately one eighth of an inch.

After partial curing of plastisol layer 18 by baking, a masking material 20 is applied over lighter colored plastisol 18 which covers the edge or lip 12B of metallic plate 12.

After masking material 20 has been applied along the edge of lip 12B, a second layer of plastisol, containing gritty particles such as aluminum oxide, is applied over layer 18. The first and second layers of plastisol may preferably be applied by spraying. The second plastisol layer 22 contains pigments of a darker color, such as preferably, black.

It is understood that other dark colors may be utilized including blue, green, brown and the like. Similarly, the lighter colors utilized in the first plastisol layer may be colors other than yellow or orange, such as white or any other light color which would produce a suitable contrast between the edge and the darker area of the second plastisol layer 22. Such spraying of plastisol layers is known to those skilled in the art and is commercially available from sources such as P & R Industries, Inc. of Doylestown, Pa.

The second plastisol layer 22 is preferably of a thickness of about one-half of the thickness of the first plastisol layer 18, and in a presently preferred embodiment would be about one sixteenth of an inch thick.

Upon completion of the spraying of the second plastisol layer 22, plastisol layers, with the gritty particles such as aluminum oxide, are baked for a complete cure as is known to those skilled in the art. Upon completion of the cure, masking material 20 is removed as illustrated in FIG. 1. Further, some trimming of the sprayed plastisol material may be necessary.

Further, it is understood that other gritty particles other than aluminum oxide may be utilized in practicing the present invention. However, in a presently preferred embodiment, aluminum oxide may be utilized.

Figure 4:
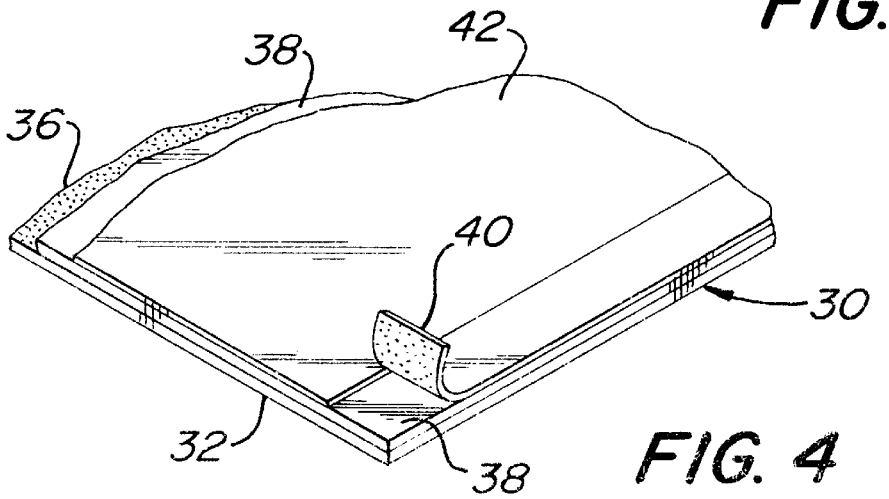
FIG. 4 is a broken away view in perspective of another embodiment of the present invention illustrating the layers and the masking material in the process of being removed.

Referring down to FIG. 4, there is shown another embodiment of the present invention wherein a flooring plate 30 may be made in accordance with the present invention. The steps in manufacturing flooring plate 30 are substantially the same as those shown and described with respect to the manufacture of tread plate 10 except that flooring plate 30 may be of a larger dimension and there would be no bending of the edge to form a lip as shown at 12B. Flooring plate 30 may be utilized for locomotive walkways, pads used in locomotive inside decks, caboose floors, dining area car floors, vestibule areas and floor standing pads beneath machinery in shops and the like. The flooring plate 30 with its lighter colored plastisol layer 38 exposed along an edge is particularly useful where there may be some discontinuity. For example, where standing area around a machine may be slightly raised and it is necessary to step on to another level. However, the flooring plate 30 is useful in any application where there may be need to provide a warning or to alert a person stepping on to or in to the area. Further, as shown in FIG. 4, the light-colored edge 38 is provided along only a single surface, however it is understood, that such edge may be provided on more than one edge of the flooring plate 30 or on all edges of flooring plate 30.

Briefly, as described in FIGS. 1 through 3, with respect to flooring plate 30, a metallic plate 32, which may preferably be stainless steel 304-2B is provided. This plate is cleaned and suitable bonding material 36 is applied on all surfaces. However, the bonding material 36 may only be necessary between the steel and the plastisol layer 38.

After plastisol layer 38, containing the gritty particles, such as aluminum oxide, is partially cured by baking, a masking material 40 is applied along one or more of the edges as illustrated in FIG. 4. A second plastisol layer 42, containing a darker pigment than the pigment contained in plastisol layer 38, is applied by spraying. Subsequent thereto, the plastisol layers, with the gritty particles therein, are cured by baking, the masking material 40 is removed and plastisol layers are trimmed as necessary. The flooring plate 30 may or may not be provided with mounting holes as desired.

With respect to all of the embodiments, the tread plates or flooring plates may be mounted either by suitable adhesive bonding or by screws, rivets or other suitable fasteners.

The tread plate 10 and the flooring plate 30 made in accordance with the method of the present invention also comprise a part of the invention. These are new plates made in accordance with applicant's novel and unobvious method.

The present invention may be embodied in other specific forms without departing from the spirit or essential attributes thereof and, accordingly, reference should be made to the appended claims, rather than to the foregoing specification as indicating the scope of the invention.

I claim:

1. A method of manufacturing a two-color non-slip tread or flooring plate, comprising the steps of, obtaining a metallic place of predetermined dimensions;

cleaning said metallic plate;

applying a bonding agent to said metallic plate;

spraying a plastisol of a first selected color across substantially all of a major surface of said metallic plate with said bonding agent applied thereto, said plastisol including gritty particles and being applied to said metallic plate in a predetermined thickness;

masking at least one edge of said plate;

spraying a plastisol of a second selected color to said plastisol of said first selected color over substantially all exposed surface of said major surface that it is not masked, said second selected color being darker than said first selected color, said plastisol of said second selected color including gritty particles and being applied in a thickness approximately half of said first predetermined thickness; and removing masking from said plate.

2. A method in accordance with claim 1 wherein said obtaining step includes the step of obtaining a metallic plate comprised of stainless steel.

3. A method in accordance with claim 1 including the step of forming said metallic plate substantially in the form of an "L" when viewed in cross-section.

4. A method in accordance with claim 3 including the step of forming holes in said plate.

5. A method in accordance with claim 1 wherein said first selected color is selected from the group of colors consisting of yellow and orange.

6. A method in accordance with claim 1 wherein said second selected color is black.

7. A method in accordance with claim 1 wherein the step of spraying the plastisol includes the spraying of a plastisol containing gritty particles comprised of aluminum oxide.

8. A method in accordance with claim 1 wherein said metallic plate is flat.

9. A method in accordance with claim 2 wherein said stainless steel is comprised of 304-2B stainless steel.

10. A two-color non-slip tread or flooring plate manufactured in accordance with the method of claim 1.

11. A two-color non-slip tread manufactured in accordance with the method of claim 3.

12. A two-color non-slip tread manufactured in accordance with the method of claim 3 wherein said spraying step includes the spraying of a plastisol containing a pigment selected from the group consisting of yellow and orange.

13. A method in accordance with claim 1 including the step of baking said plastisols after spraying.

* * * * *